US005222384A

United States Patent [19]

Evans

[11] Patent Number: 5,222,384

[45] Date of Patent: Jun. 29, 1993

[54] RECIPROCAL CONDUIT BENDER

[76] Inventor: Roland J. Evans, 2901 Hanover Dr., Bloomington, Ill. 61704

[21] Appl. No.: 856,585

[22] Filed: Mar. 24, 1992

[51] Int. Cl.[5] ..... B21D 7/14

[52] U.S. Cl. ..... 72/34; 72/35; 72/301; 72/308; 72/311; 72/386

[58] Field of Search ..... 72/295, 301, 305, 308, 72/311, 316, 322, 323, 389, 386, 33, 34, 35

[56] References Cited

U.S. PATENT DOCUMENTS

| | | | |
|---|---|---|---|
| 799,670 | 9/1905 | Reynolds . | |
| 1,816,218 | 7/1931 | Henry et al. . | |
| 1,910,769 | 5/1933 | Jaynes | 72/390 |
| 2,273,655 | 2/1942 | Olsen | 153/32 |
| 2,604,924 | 7/1952 | Blake | 72/386 |
| 2,697,469 | 12/1954 | Becroft | 153/32 |
| 2,708,471 | 5/1955 | Ballard | 153/32 |
| 2,998,838 | 9/1961 | Byrd | 72/311 |
| 3,075,568 | 1/1963 | Bright | 72/316 |
| 3,385,092 | 5/1968 | Scott | 72/301 |
| 3,396,565 | 8/1968 | Miller | 72/311 |
| 3,456,468 | 7/1969 | Crippen | 72/34 |
| 3,557,586 | 1/1971 | Zmuda | 72/22 |
| 3,662,581 | 5/1972 | Early | 72/305 |
| 3,731,513 | 5/1973 | Kindermann | 72/295 |
| 3,760,626 | 9/1973 | Sharar | 72/389 |
| 3,842,648 | 10/1974 | Schwartz | 72/301 |
| 4,031,733 | 6/1977 | Coody | 72/386 |
| 4,056,960 | 11/1977 | Kawanami | 72/128 |
| 4,061,005 | 12/1977 | Kawanami et al. | 72/30 |
| 4,195,506 | 4/1980 | Kawanami et al. | 72/8 |
| 4,351,178 | 9/1982 | Uehara | 72/390 |
| 4,412,442 | 11/1983 | Kawanami et al. | 72/128 |
| 4,596,128 | 6/1986 | Ringersma et al. | 72/128 |

FOREIGN PATENT DOCUMENTS

| | | | |
|---|---|---|---|
| 5231 | 9/1878 | Fed. Rep. of Germany | 72/390 |
| 1444385 | 7/1976 | United Kingdom | 72/389 |

*Primary Examiner*—Daniel C. Crane

*Attorney, Agent, or Firm*—Allegretti & Witcoff, Ltd.

[57] ABSTRACT

A reciprocating bender for conduit which may make equal and opposite bends in a length of conduit. The reciprocating bender includes a bending deck, a traveling bending shoe, a rising bending shoe, a jack, and a stabilizer. The conduit is placed adjacent the traveling and rising bending shoes, and the stabilizer holds the conduit in place. The jack elevates the rising bending shoe above the deck, causing the conduit to make both equal and opposite bends about the two bending shoes.

6 Claims, 7 Drawing Sheets 52
20
24
30
50
26
34
28
36
32
40
38

52
28
78
76
70
22
96
74
56
58
34
94
92
32
87
88

52
28
96
78
76
70
22
94
92
95
34
28
88
74
56
58
32
87

Fig.8
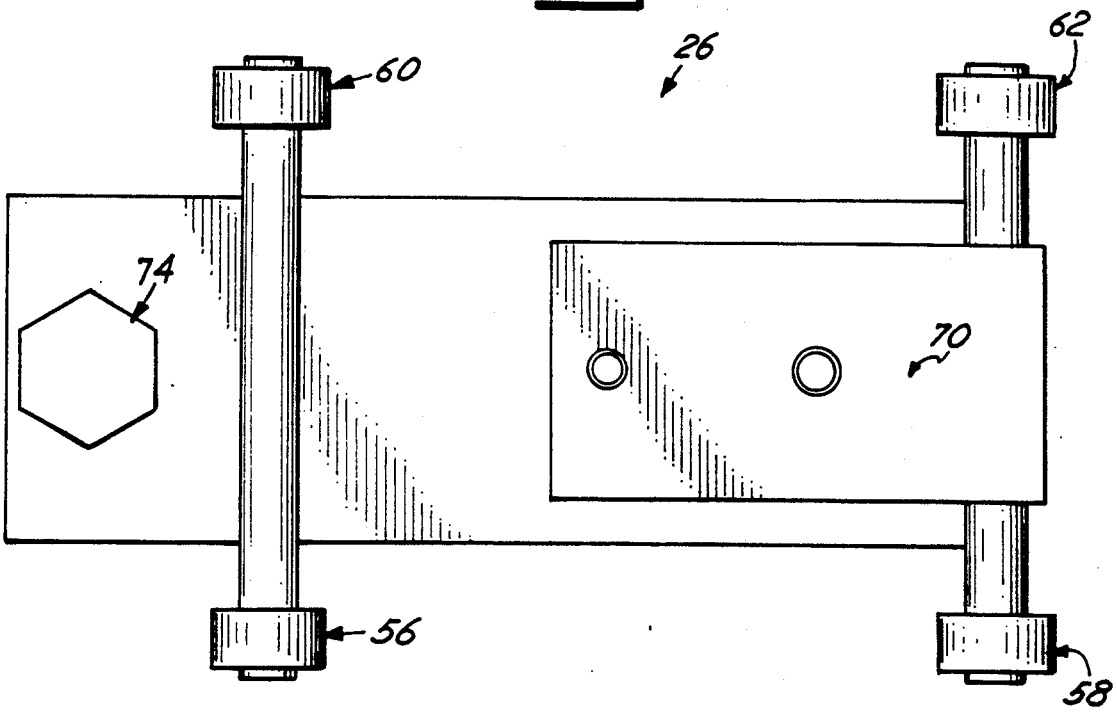
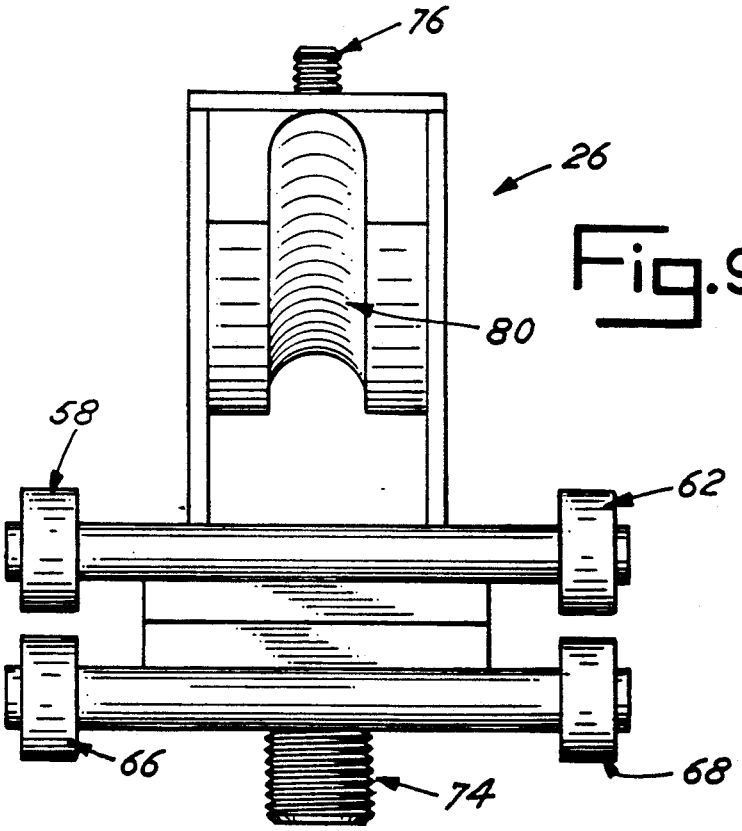
Fig.9

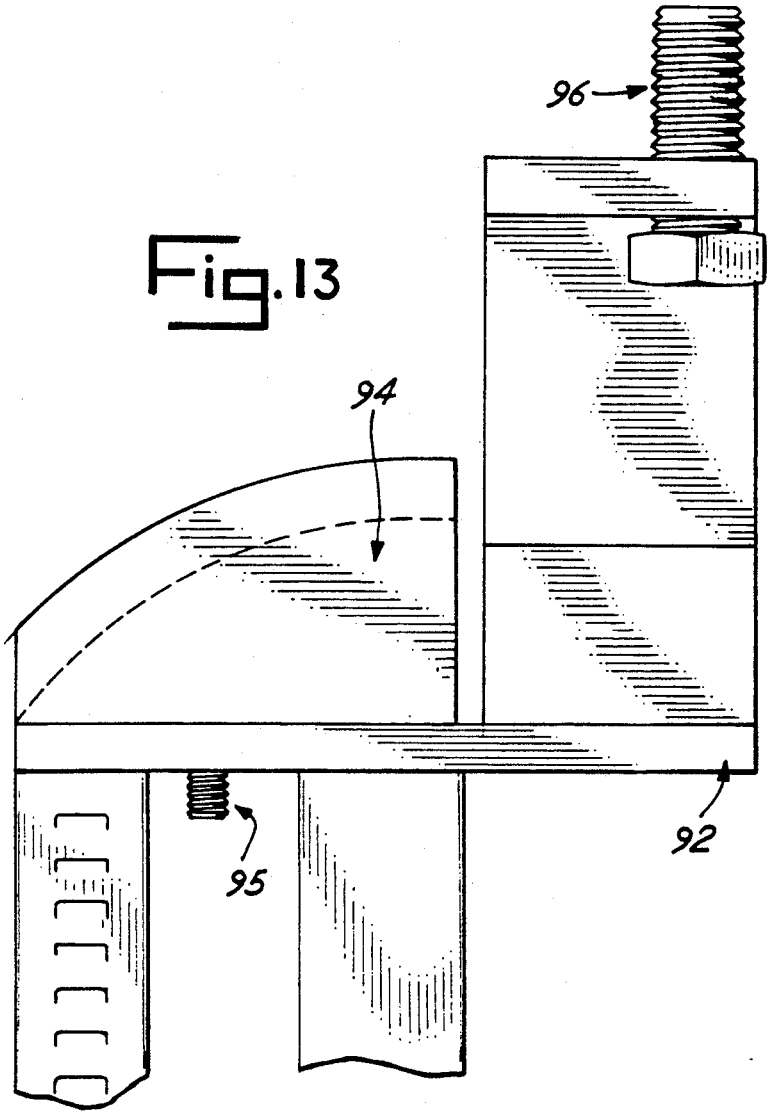
Fig. 13
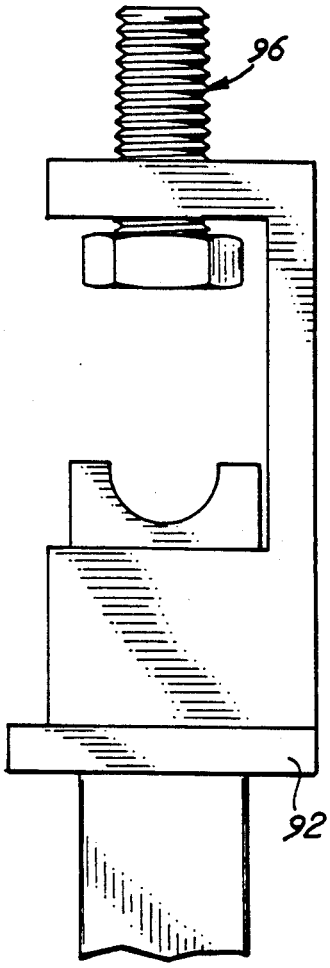
Fig. 14
Fig. 15
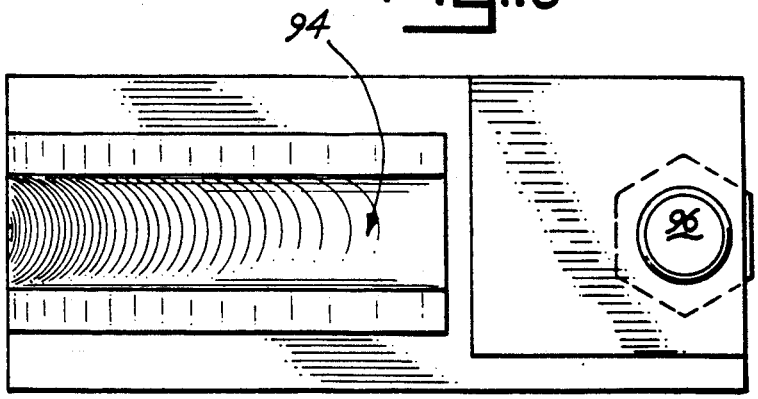

RECIPROCAL CONDUIT BENDER

BACKGROUND OF THE INVENTION

The present invention relates generally to apparatus for bending tubes, such as electrical wire conduits and other pipes, and more particularly to a dual action offset bender that automatically makes two bends in a length of pipe substantially simultaneously. In many applications, pipe, such as electrical conduit, is installed where the pipe must be bent to accommodate a physical structure in the path where the pipe is to be routed. For example, electrical conduit, which serves as a mechanical protection for electrical wires, must often be bent so as to "go around" a beam, pillar, or other obstruction in a building. In such circumstances, the conduit must be bent in first direction (to "go around" the obstruction) and after extending a short distance, must be bent in a second, but opposite, direction. In this way, the pipe continues in its course, substantially parallel to its original course, but offset in order to avoid the obstruction. After passing the obstruction, the craftsman installing the conduit may bend the conduit a third and fourth time (again in opposite directions) so that the conduit resumes its initial path.

Many commonly available devices for bending conduit make only one bend in the conduit at a time. This is inconvenient where two equal and opposite bends are to be made in the conduit. If a first bend is made at a particular angle, the device must be employed a second time. Moreover, if a second bend is to be made, the bending device must be carefully utilized to ensure that the bend is made in the opposite direction and with the same angle as the first bend. Errors in operating the device or failure to measure the angle of the first bend accurately will result in a length of conduit which does not veer away from an obstruction in a orderly fashion.

Other devices are expensive to make. Still other conduit benders are too heavy to conveniently bring to a construction site where a bender would be utilized.

SUMMARY OF THE INVENTION

In a principal aspect, the present invention is a reciprocal bender for conduit and other pipes. The bender includes a bending deck, a traveling bending shoe movably attached to the bending deck, a rising bending shoe, and a jack for elevating the rising bending shoe above the bending deck.

Accordingly, a length of conduit or other pipe may be placed on the deck, adjacent the traveling and rising bending shoes. The jack elevates the rising bending shoe. Substantially equal and opposite bends are consequently made in the pipe by the traveling and rising bending shoes. The amount of the bend is determined by the height that the rising shoe is raised, and the distance between the bends is determined by the placement of the traveling bending shoe along the deck.

Thus, an object of the present invention is an improved reciprocal bender for conduit or other pipes. Yet another object is an improved bender that more easily allows for equal and opposite bends to be made in a length of tubing substantially simultaneously. Another object is an improved bender that has a lighter weight and that is easier and less expensive to manufacture. Still another object is a conduit bender that is easier to operate and more reliable.

These and other objects, features, and advantages of the present invention are discussed or apparent in the following detailed description.

BRIEF DESCRIPTION OF THE DRAWING

A preferred embodiment of the present invention is described herein with reference to the drawing wherein

FIG. 8 is a top plan view of the traveling shoe assembly of the preferred embodiment shown in FIG. 1;

FIG. 9 is an end view of the traveling shoe assembly of the preferred embodiment shown in FIG. 1;

FIG. 13 is a side view of the rising shoe assembly of the preferred embodiment shown in FIG. 1;

FIG. 14 is an end view of the rising shoe assembly of the preferred embodiment shown in FIG. 1; and FIG. 15 is a top plan view of the rising shoe assembly of the preferred embodiment shown in FIG. 1.

DETAILED DESCRIPTION OF THE PREFERRED EMBODIMENT

Figure 1:
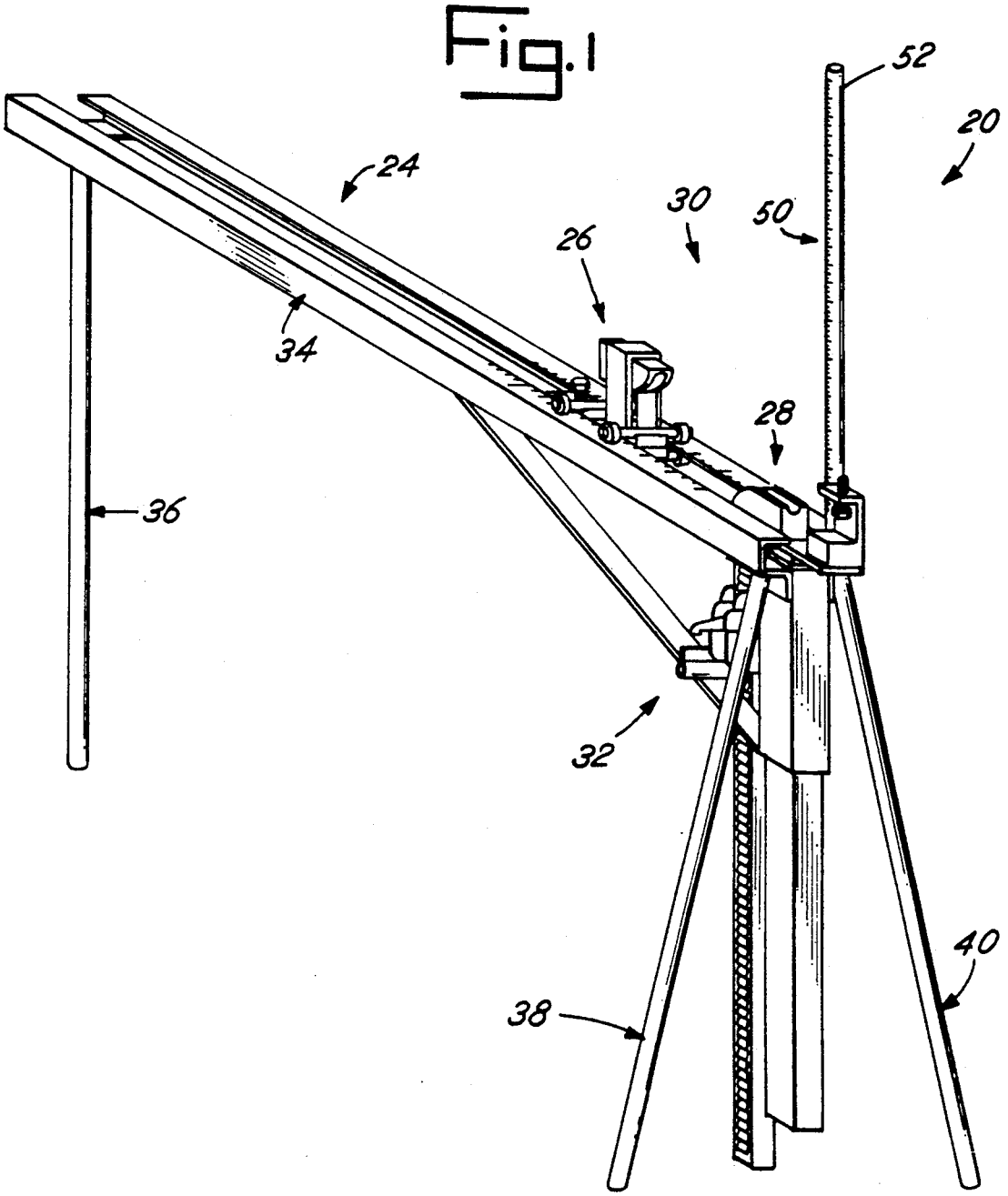
FIG. 1 is a isometric view of a preferred embodiment of the present invention.
Figure 2:
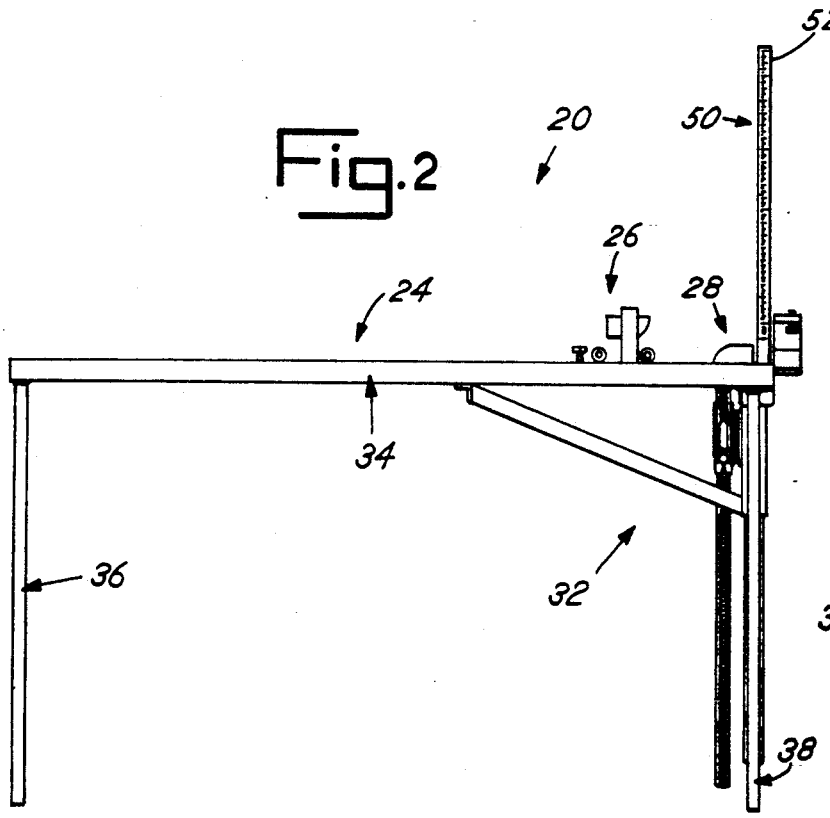
FIG. 2 is a side view of the preferred embodiment shown in FIG. 1.
Figure 4:
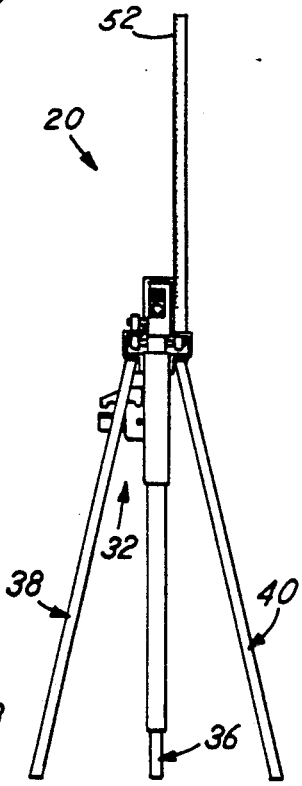
FIG. 4 is an end view of the preferred embodiment shown in FIG. 1.
Figure 3:
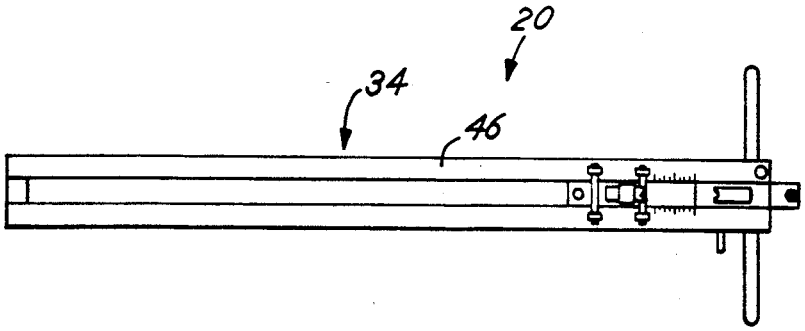
FIG. 3 is a top plan view of the preferred embodiment shown in FIG. 1.

Referring to FIGS. 1–15, the present invention is an improved reciprocal bender 20 for a length of conduit 22 or other pipe. The bender 20 includes a bending deck, 24, traveling shoe assembly 26, rising shoe assembly, 28, stabilizing assembly 30, and jack 32. The deck 24 includes a horizontal base 34 approximately 60 inches long and three legs 36, 38, 40 to support the base 34 at a comfortable working height above the ground.

The base 34 defines inner and outer surface 44, 46, which cooperate with the traveling shoe assembly 26, for allowing the traveling shoe assembly 26 to roll along the length of the base 34. See FIGS. 1 and 8–10.

The base 34 further includes length markings 48 along the outer surface 46 of the base 34, to indicate the position of the traveling shoe assembly 26, and length markings 50 along a measuring pole 52. The measuring pole 52 is fixed to the base 34 a predetermined angle. The jack assembly 32 elevates the rising shoe assembly 28 at substantially the same predetermined angle to the base 32, such that the markings 50 indicate the height of the rising shoe assembly 28 with respect to the base 34 (and the traveling shoe assembly 26).

As shown in FIGS. 5–9, the traveling shoe assembly 26 includes a rolling deck unit 54, four wheels 56, 58, 60, 62 adjacent the outer surface 46 of the deck 24, and four wheels 64, 66, 68 (only three wheels shown) adjacent to the inner surface 44 of the deck 24. The assembly 26 rolls along the deck. The assembly 26 further includes a removably attached traveling bending shoe 70.

The stabilizing assembly 30 is cooperatively defined, in part, by a bolt 74 adjustably fixed in the deck unit 54. The bolt 74 may be positioned up or down to hold a length of conduit 22 (shown in FIG. 5) between the first bending shoe 70 and the bolt 74.

The first bending shoe 70 includes a threaded bolt 76 to detachably secure the shoe 70 to the deck unit 54 and a fixed alignment dowel pin 78 that aligns the shoe 70 in position on the rolling deck unit 54. See FIG. 9. The shoe 70 further includes a rounded bending surface 80 which forms the curve that the conduit 22 will take.

Figure 11:
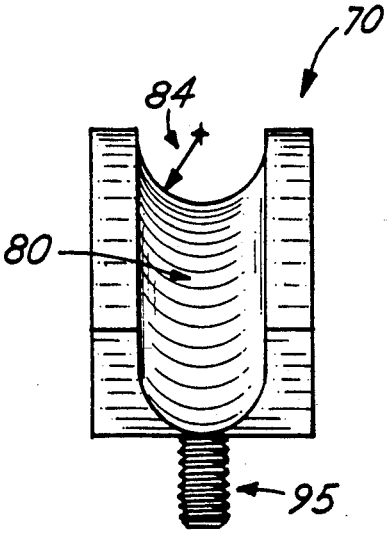
FIG. 11 is an end view of a removable shoe of the preferred embodiment shown in FIG. 1.
Figure 12:
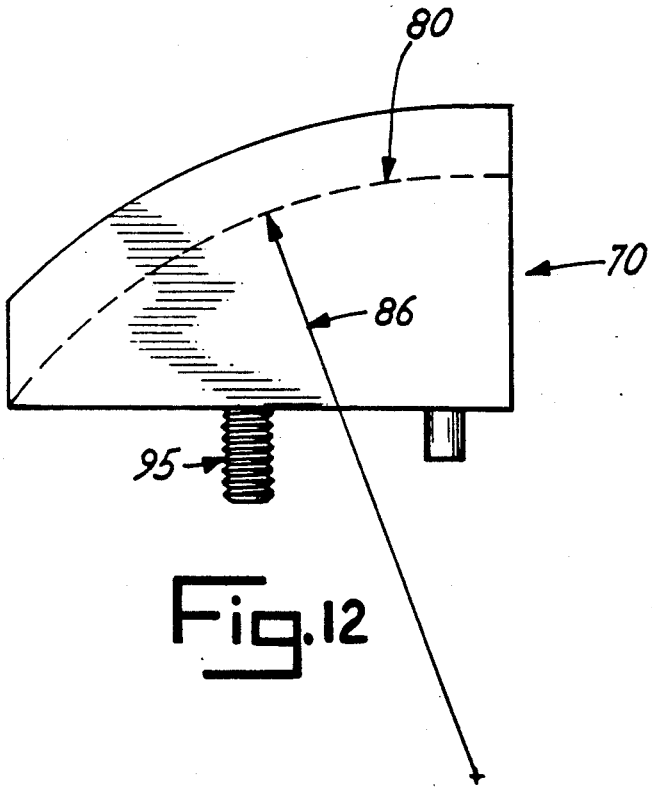
FIG. 12 is a side view of a removable shoe of the preferred embodiment shown in FIG. 1.

As shown in FIGS. 11 and 12, the shoe 70 may be concave to accommodate conduits of a variety of different outside diameters including, for example, one-half inch, three-quarter inch, and one inch conduits. Other conduits of larger or smaller sizes may also be used with the present invention.

The bends of the shoe 70 define first and second radius lines 84, 86. Thus, for example, when the first radius is $\frac{3}{8}$ inch, to accommodate $\frac{1}{2}$ inch conduit, the second radius equals 4 inches. When the first radius is $\frac{1}{2}$ inch, to accommodate $\frac{3}{4}$ inch pipe, the second radius equals 4 $\frac{1}{2}$ inches. When the first radius is $\frac{5}{8}$ inch, to accommodate 1 inch conduit, the second radius equals 5 $\frac{3}{4}$ inches.

The rising shoe assembly 28 includes a sleeve 87 fixedly attached at an angle (such as 90°) to the deck 24, a sliding pipe 88 within sleeve 87, and a rising shoe mechanism 90 at the upper end of the pipe 88. The rising shoe mechanism 90 includes a base 92 and a rising bending shoe 94. The rising bending shoe 94 is detachably connected to the base 92. The shoe 94 includes a concave portion to accommodate the outside diameter of the conduit 22. See FIGS. 11–15.

As with the traveling bending shoe 70, different rising bending shoes may be attached, via a bolt 95, to accommodate different size conduits. The stabilizing assembly 30 is further cooperatively defined by a bolt 96 (or other adjustment mechanism) to hold the conduit in a substantially fixed relation to the rising bending shoe 94. Notably, the traveling bending shoe 70 and rising bending shoe 94 are interchangeable.

Figure 5:
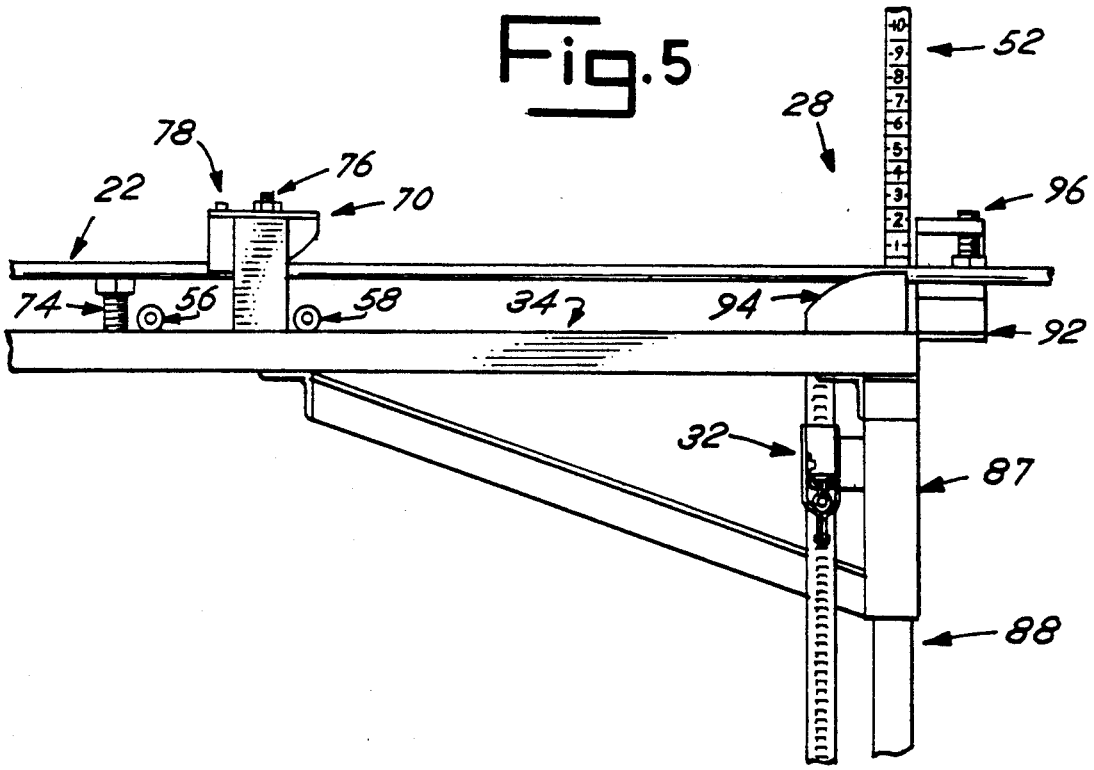
FIG. 5 is a partial side view of the preferred embodiment shown in FIG. 1, showing an unbent length of conduit in the bender.
Figure 6:
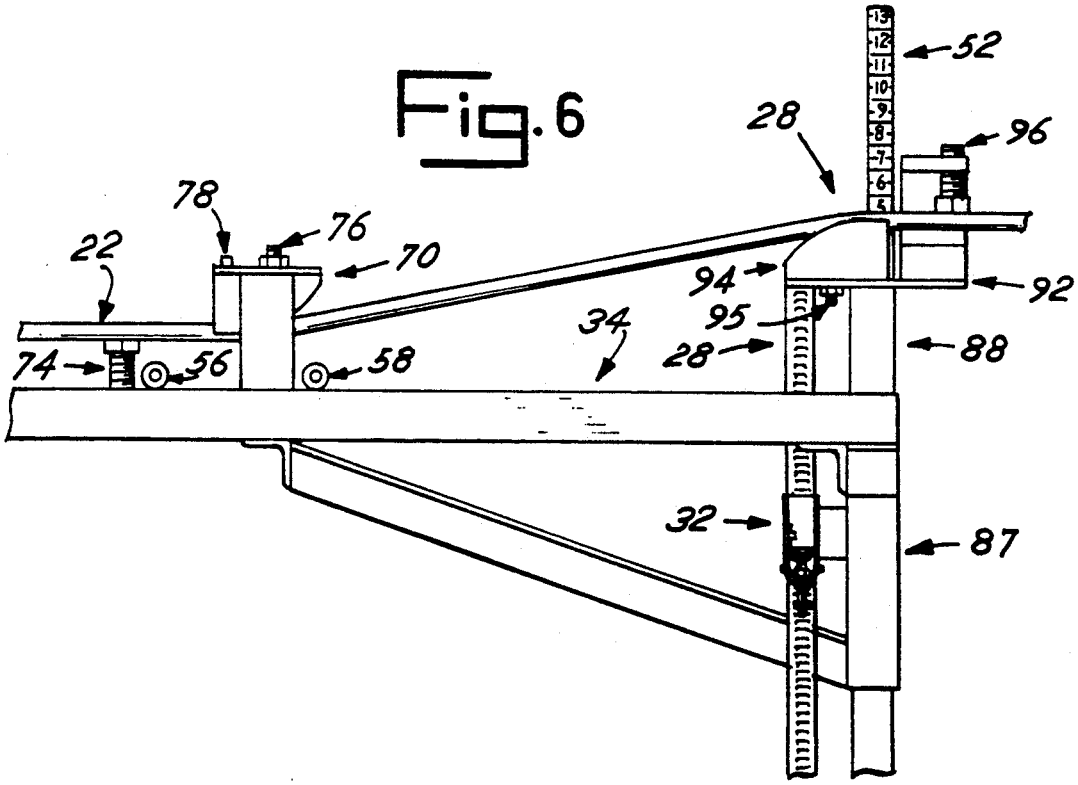
FIG. 6 is a partial side view of the preferred embodiment shown in FIG. 1, showing a bent length of conduit in the bender.
Figure 7:
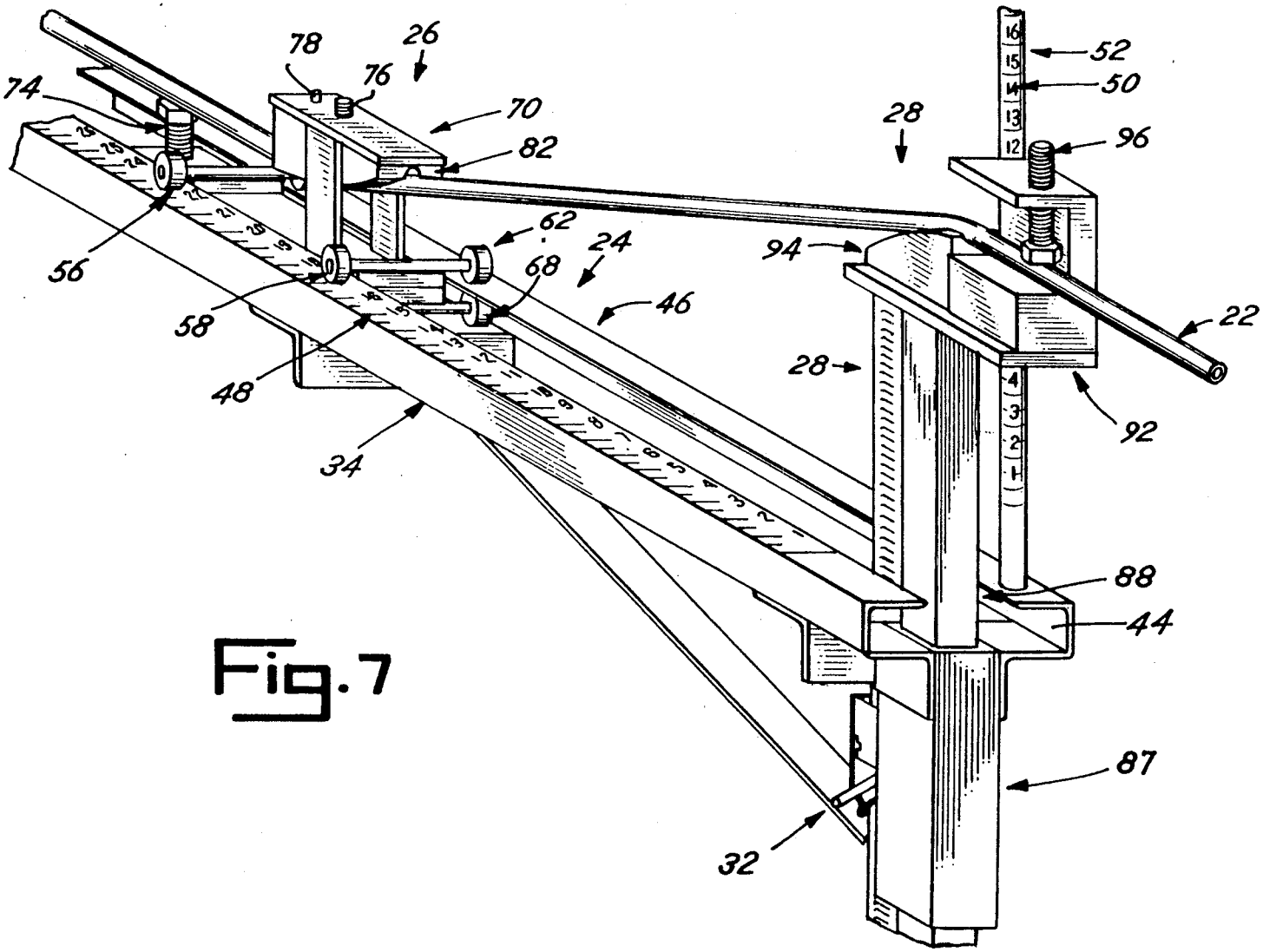
FIG. 7 is a partial isometric view of the preferred embodiment shown in FIG. 1, showing a bent length of conduit in the bender.
Figure 10:
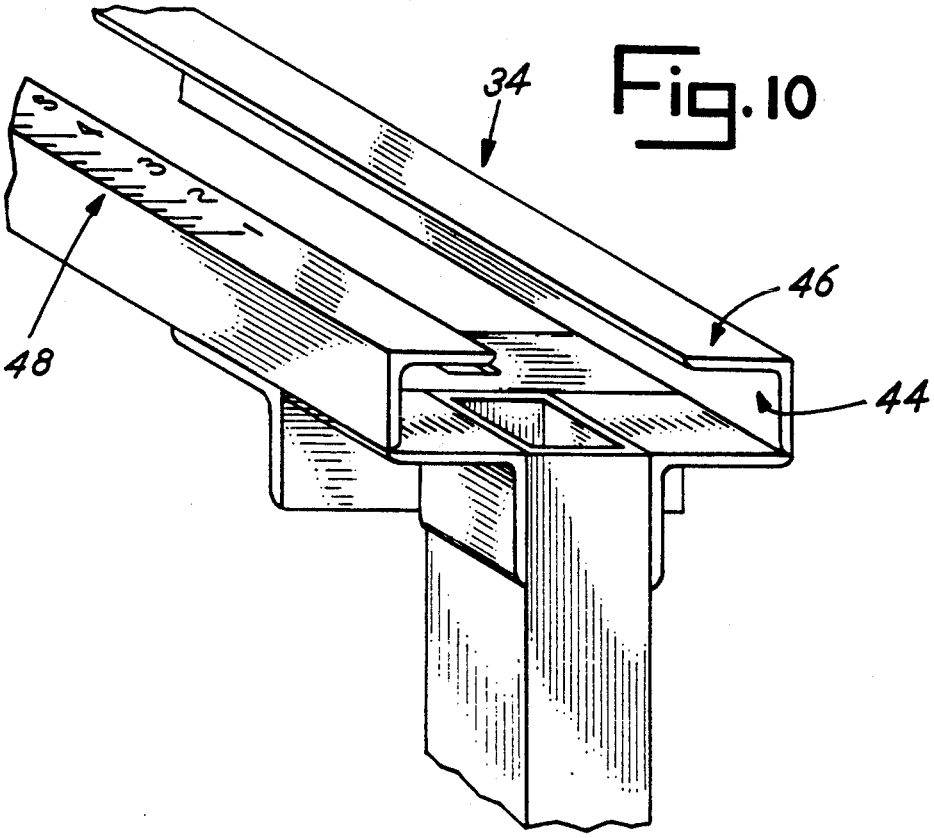
FIG. 10 is a partial isometric view of the bending deck of the preferred embodiment shown in FIG. 1.

The jack 32 elevates the rising shoe mechanism 90 away from the deck 34. Accordingly, when the conduit is placed as shown in FIG. 5 and the jack 32 is activated, the jack 32 pushes upward on the rising bending shoe 94. The pipe 88 within the sleeve 87 rises up. When the rising bending shoe 94 rises, the conduit 22 is necessarily bent by both the traveling and rising bending shoes 70, 94, in opposite and substantially equal angles. See FIGS. 6 and 7.

Accordingly, a substantially straight piece of conduit 22 may be applied between the bolt 74 and traveling bending shoe 70 and between the bolt 96 and the rising bending shoe 94. The bolts 74, 96 are tightened to position the conduit on the apparatus 20. The jack 32 is then activated to raise the second shoe assembly 90 vertically with respect to the horizontal bending deck 34.

If, for example, an operator wishes to make two 30° bends in the conduit, he or she may place the conduit 22 as shown in FIG. 5 and position the traveling shoe assembly 26 thirty inches from the rising shoe mechanism 90, as indicated by the markings 48. The jack 32 is activated to raise the rising bending shoe 94 fifteen inches above the deck 34, as indicated by the markings 50. The bolts 74, 96 are then untightened, and the conduit 22 removed.

A single preferred embodiment of the present invention has been described herein. It is to be understood, however, that changes and modifications can be made without departing from the true scope and spirit of the present invention. For example, a hydraulic jack could be substituted for the mechanical jack 32 shown. Clamps or other holding devices could be substituted for the bolts 74, 96, which help to cooperatively define the stabilizer 28. A slide may be substituted for the rollers 56–72 on the traveling shoe assembly 26. The true scope and spirit of the present invention are defined by the following claims, to be interpreted in light of the foregoing specification.

I claim:

1. A bender for simultaneously making only two reciprocal, offset bends in an electrical conduit, said electrical conduit having first and second ends, comprising, in combination:

a bending deck;

a traveling bending shoe assembly for receiving said first end of said conduit and freely movable along said deck towards and away from one end of said deck, said traveling bending shoe including retainer means for keeping said shoe substantially adjacent said deck, said traveling bending shoe also including a traveling cradle for receiving said first end of said conduit, said traveling cradle defining a rounded surface with a predetermined radius for making a bend in said conduit;

a rising bending shoe for receiving said second end of conduit and movable along a linear path in a direction above and away from said deck, said rising bending shoe being mounted at said one end of said deck, said rising bending shoe including a rising cradle for receiving said second end of said conduit, said rising cradle defining a rounded surface with a predetermined radius for making a bend in said conduit;

first stabilizing means mounted on said traveling bending shoe for holding said first end of said conduit substantially adjacent said traveling bending shoe, said first stabilizing means being located relative to said traveling cradle so that said conduit is engaged by said first stabilizing means and said traveling cradle at opposite sides and longitudinally spaced positions on said conduit;

second stabilizing means mounted on said rising bending shoe for holding said second end of said conduit substantially adjacent to the rising bending shoe, said second stabilizing means being located relative to said rising cradle so that said conduit is engaged by said second stabilizing means and said rising cradle at opposite sides and longitudinally spaced positions on said conduit;

jack means, extending between said bending deck and said rising bending shoe, for moving said rising bending shoe along said linear path away from said deck, said traveling bending shoe freely moving in association with and toward said rising bending shoe along said bending deck as said jack means moves said rising bending shoe away from said deck, said jack means, traveling bending shoe, rising bending shoe, and first and second stabilizing means cooperatively defining wrapping means for simultaneously wrapping said first end of said conduit about said first cradle and said second end of said conduit about said second cradle as said jack moves, said wrapping means making substantially equal and opposite bends in said first and second ends of said conduit, said bender consisting of only said traveling and rising bending shoes and said first and second stabilizing means to produce said two reciprocal, equal and opposite bends in the conduit.

2. A bender as claimed in claim 1 further comprising a measurement indicator, substantially adjacent said rising bending shoe, for indicating distance above said deck as said jack elevates said rising bending shoe.

3. A bender as claimed in claim 2 wherein said bending deck includes a measurement indicator thereon for positioning said traveling bending shoe.

4. A bender as claimed in claim 1 wherein said jack comprises a mechanical jack.

5. A bender as claimed in claim 1 wherein said jack comprises a hydraulic jack.

6. A bender as claimed in claim 1 further comprising a traveling deck unit for moving along said base and wherein said traveling bending shoe is removably attached to said traveling deck unit.

* * * * *